United States Patent [19]

Brimm

[11] 4,376,662

[45] Mar. 15, 1983

[54] METHODS FOR FABRICATING METALLIC WORKPIECES

[75] Inventor: Daniel J. Brimm, La Jolla, Calif.

[73] Assignee: Chem-tronics, Inc., El Cajon, Calif.

[21] Appl. No.: 146,396

[22] Filed: May 5, 1980

[51] Int. Cl.[3] ..... C21D 1/78

[52] U.S. Cl. ..... 148/12.3; 72/364; 148/130; 148/131

[58] Field of Search ..... 72/342, 364; 148/130, 148/131, 12.3, 12.7 R

[56] References Cited

U.S. PATENT DOCUMENTS

| | | | |
|---|---|---|---|
| 693,179 | 2/1902 | Sneddon | 72/364 |
| 3,298,096 | 1/1967 | Stuart | 72/342 |
| 3,383,900 | 5/1968 | Van Hartesveldt | 72/342 |
| 3,550,422 | 12/1970 | Potter | 72/342 |
| 3,805,567 | 4/1974 | Agius-Sinerco | 72/342 |

OTHER PUBLICATIONS

Wilson, "Forming of Hi-Temperature Metals", ASME Paper #61-AV-6, 3/61.

*Primary Examiner*—Lowell A. Larson
*Attorney, Agent, or Firm*—LeBlanc, Nolan, Shur & Nies

[57] ABSTRACT

Methods for fabricating metallic components in which expansion of a mandrel and changes that take place in the workpiece material during precipitation hardening—phase changes, volume contraction, and increased ductility—are utilized to size the component to a selected diameter and to stabilize the component at that diameter. Mandrels for such methods.

16 Claims, 4 Drawing Figures

METHODS FOR FABRICATING METALLIC WORKPIECES

The present invention relates to methods for fabricating metallic workpieces and, more particularly, to novel, improved methods for precisely sizing tubular workpieces fabricated of heat hardenable metal alloys.

The novel fabrication techniques disclosed and claimed herein are particularly useful in the manufacture of components for missiles and high speed aircraft; and the principles of the present invention will accordingly, to some extent, be developed by reference to such applications. It is to be understood, however, that this is being done for the sake of clarity and conciseness and is not intended to limit the scope of the invention as defined in the appended claims.

Many missile and aircraft components must be made from materials which are capable of withstanding high temperatures for extended times.

Often, precipitation hardenable stainless steels are among the best materials from which such components can be made. They retain a large part of their strength in the 600°–1100° F. range and have good corrosion resistance and a high strength-to-weight ratio. Furthermore, in the annealed condition, such alloys are relatively soft and may be fabricated by techniques similar to those used in fabricating standard austenitic stainless steels. Unlike the latter, however, the precipitation hardening grades of stainless steel cannot be hardened by cold working, but must be hardened by aging them at temperatures in the range of 800°–1400° F.

The precipitation hardening grades of stainless steels undergo volume changes during the aging treatment employed to harden them. Consequently, the fabrication of components from those materials to close tolerances by heretofore available techniques has posed a considerable problem.

A number of techniques have been employed to overcome this problem. These include chemical milling, machining from heavy sections, and post-hardening expansion. In many cases, however, the foregoing, and other, techniques for fabricating precisely dimensioned components from precipitation hardening alloys are either completely unusable or uneconomical. On the other hand, employment of the materials in the annealed condition is typically not a satisfactory solution to the problem as the alloys possess the necessary physical characteristics only after they have been age hardened.

I have now developed a novel, improved method of fabricating tubular components from heat hardenable alloys which has the important advantage that a precisely dimensioned component can be economically obtained in the hardened condition to take advantage of the physical properties that can be obtained only by hardening.

My novel technique of fabricating precisely dimensioned components utilizes the very properties of precipitation hardening alloys that have heretofore made them difficult to fabricate to close tolerances. Specifically, such alloys undergo a number of physical changes during precipitation hardening. Not all of these are known, but it seems safe to say that these include an at least partial phase change, volume contraction, and an increase in ductility. In any event, I have found that advantage can be taken of the physical changes which occur to cause a precipitation hardening alloy to flow plastically during hardening. By inducing such flow, the workpiece can be sized during precipitation hardening; and then, because of the nature of the flow, the workpiece will stabilize at the dimension, or dimensions, to which it is sized.

In the initial steps of my novel fabrication technique, I roll form readily available sheets of close tolerance, heat hardenable materials, in the annealed condition, into cylinders and then join the edges of those cylinders, typically by electron beam welding, into a component of cylindrical configuration.

The cylindrical component is then expanded to the wanted diameter and stabilized at that diameter and the wanted physical properties developed in the material from which the component is fabricated. This is done by installing the component on a male mandrel fabricated of a material with a coefficient of expansion such that it will expand the tubular component to the desired diameter during the aging treatment appropriate to the alloy being treated and the end use of the component. The assembly is then subjected to the appropriate heat treatment.

During the course of the heat treatment, the mandrel expands, and the workpiece material is thereby caused to flow, increasing the diameter of the component to the wanted dimension. This can be effected with great precision as the expansion of the mandrel is accurately calculatable and controllable; and the workpiece takes a permanent set at the dimension to which it is expanded because of the nature of workpiece deformation resulting from the volume contraction of and other physical changes in the workpiece material during the precipitation hardening.

One family of materials which may be fabricated by the novel technique discussed above includes those which are hardened by precipitation from a martensitic matrix alone. This family includes 17-4 PH and 15-5 PH stainless steels.

Alloys in this family can be hardened to the H 925, H 1050, H 1075, and H 1150 conditions, respectively, by heating them to temperatures of 925°, 1025°, 1075°, and 1150° F. for periods of one to four hours and then cooling them in air.

They can also be hardened to the H 1150 M condition utilized for enhanced corrosion resistance by heating them to 1400° F., holding them at that temperature for two hours, air cooling them, reheating the component to 1150° F., holding it at that temperature for one to four hours, and then air cooling it.

A second, exemplary group of alloys from which tubular components can be fabricated in accord with the principles of the present invention include those which are hardened by a combination of transformation from an austenitic to a martensitic matrix and precipitation from the latter. These alloys include 17-7 PH, PH 15-7 Mo, PH 13-4 Mo, PH 13-8 Mo, and PH 14-8 Mo stainless steels.

These alloys can be sized and hardened by heating them at temperatures in the range of 875°–1150° F. for periods of one to four hours and then cooling them.

They can also be hardened to the H 1150 M condition by heating them at 1400° F. for two hours, air cooling them, reheating the component at 1150° F. for four hours, and then cooling it.

Appropriate aging or hardening regimens for other precipitation hardenable alloys are described in the literature or can be ascertained by straightforward, relatively simple testing.

U.S. Pat. Nos. 1,409,562 issued Mar. 14, 1922, to Mason; 3,298,096 issued Jan. 17, 1967, to Stuart; 3,315,513 issued Apr. 25, 1967, to Ellenburg; 3,383,900 issued May 21, 1968, to Van Hartesveldt; 3,728,886 issued Apr. 24, 1973, to Wightman; 3,805,567 issued Apr. 23, 1974, to Agius-Cinerco; 3,834,013 issued Sept. 10, 1974, to Gerstle; 3,845,547 issued Nov. 5, 1974, to Reynolds; 3,950,976 issued Apr. 20, 1976, to DeHove; and 3,986,654 issued Oct. 19, 1976, to Hart et al. are all concerned with methods for thermally sizing metallic components of various shapes. However, none of these prior art techniques employ my novel combination of mandrel expansion and volume contraction in a material that changes physically to a dimensionally stabilizable form during the sizing process. In fact, nothing in the foregoing references suggests that precipitation hardening alloys can be thermally sized at all. Furthermore, prior art thermal sizing techniques typically employ temperatures high enough to substantially reduce the strength of the component being fabricated. In contrast, my novel process is designed to cope with materials which retain a large part of their strength at the temperatures at which they are aged to harden them.

From the foregoing it will be apparent to the reader that one important and primary object of the present invention resides in the provision of novel, improved methods for fabricating tubular components or assemblies for high temperature and other demanding applications.

Another important and also primary object of my invention resides in the provision of novel, improved methods of precisely sizing components fabricated of metallic alloys which must be aged at elevated temperatures to develop a hardened condition.

A related important and primary object of the present invention is the provision of novel, improved methods for precisely sizing precipitation hardening metallic alloys.

Yet another important and primary object of my invention is the provision of novel, improved methods for fabricating metallic components in which advantage is taken of mandrel expansion and of volume contraction and other physical changes in the workpiece material to precisely size the component and to stabilize it in the form to which it is sized.

Still other important and related but more specific objects of my invention are to provide methods as aforesaid which are economically feasible and which are applicable to the fabrication of a variety of alloys, especially the precipitation hardening stainless steels.

Yet another important, also related, object of my invention resides in the provision of novel male mandrels for sizing tubular workpieces and, more specifically, in the provision of such mandrels which are capable of affecting the wanted sizing of the workpiece while reducing the time required to bring the workpiece up to temperature and while promoting uniform heating of the workpiece.

Other important objects and advantages and additional features of my invention will become apparent from the foregoing, from the appended claims, and from the ensuing detailed description and discussion of the invention taken in conjunction with the accompanying drawing in which:

Figure 1:
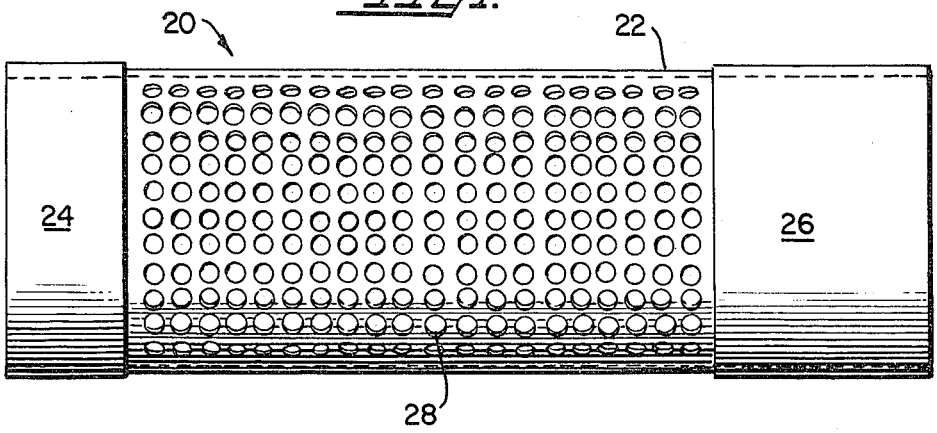
FIG. 1 is a side view of a tubular workpiece which can be precisely sized to a wanted diameter in accord with the principles of the present invention.

Referring now to the drawing, FIG. 1 depicts a cylindrical or tubular component 20 formed and ready to be sized and aged in accord with the principles of the present invention.

Component 20 was required to have a final diameter of 20.050+0.020−0.000 inches and a length of approximately 67 inches, and specifications required that the component be hardened to the H 1150 condition.

The central section 22 of the component was roll formed into a cylinder from approximately 0.050 inch thick 17-4 PH stainless steel in the annealed condition perforated with circular holes approximately two inches in diameter. The two edges of the sheet from which this section was rolled were joined by electron beam welding.

End sections 24 and 26 were rolled from 0.250 inch thick 17-4 PH stainless steel, also in the annealed condition; and they were likewise welded with an electron beam welder and welded to central section 22 by the same technique.

After being fabricated in the manner just described, component 20 was mechanically expanded 0.5 to 1.5 percent in diameter to 19.995/20.005 inches internal diameter. This was done to reduce end flare and reduce deformities caused by forming the perforations 28 in the central section 22 of the component.

Figure 2:
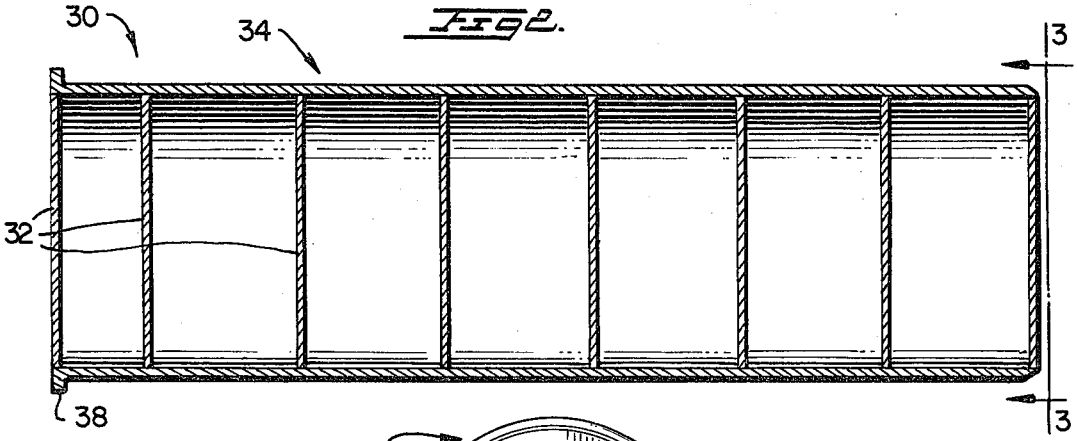
FIG. 2 is a longitudinal section through a male mandrel constructed in accord with the principles of the invention and employed to size the workpiece of FIG. 1.
Figure 3:
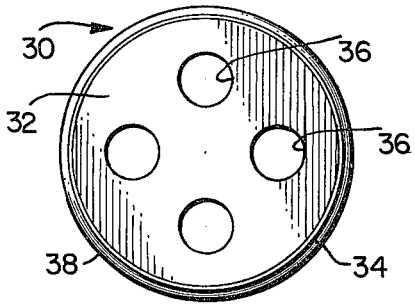
FIG. 3 is an end view of the mandrel taken substantially along line 3—3 of FIG. 2.

Component 20 was then thermally sized by the expansion of the mandrel 30 illustrated in FIGS. 2 and 3.

The latter was fabricated from 0.50 inch thick cylindrical sections of A286, which is a heat resistant, Fe-Ni-Cr-Mo alloy.

These sections were electron beam welded together; and internal, disc-like supports 32, all 0.750 inch thick, were welded in the cylindrical part 34 of the mandrel at its ends and at intervals therealong. Perforations 36 were formed in these discs to reduce the time needed to bring the assembly of it and workpiece 20 up to the aging or hardening temperature and to promote uniform heating of the workpiece.

An external, annular flange 38 was formed on one end of mandrel 30 to locate workpiece 20 therealong, and the opposite end was beveled as indicated by reference character 40 to facilitate the installation of the workpiece on the mandrel.

A286 is a heat resistant, precipitation hardening, austenitic alloy. Mandrel 30 was consequently stress relieved and stabilized twice at 1150° F. for four hours. It was then machined to an external diameter of 19.980 inches and coated with a high temperature lubricant containing graphite and molybdenum disulfide.

Component 20 was then heated to a temperature ranging, in different instances, from 400°-600° F. to expand it and then slipped onto the mandrel.

Figure 4:
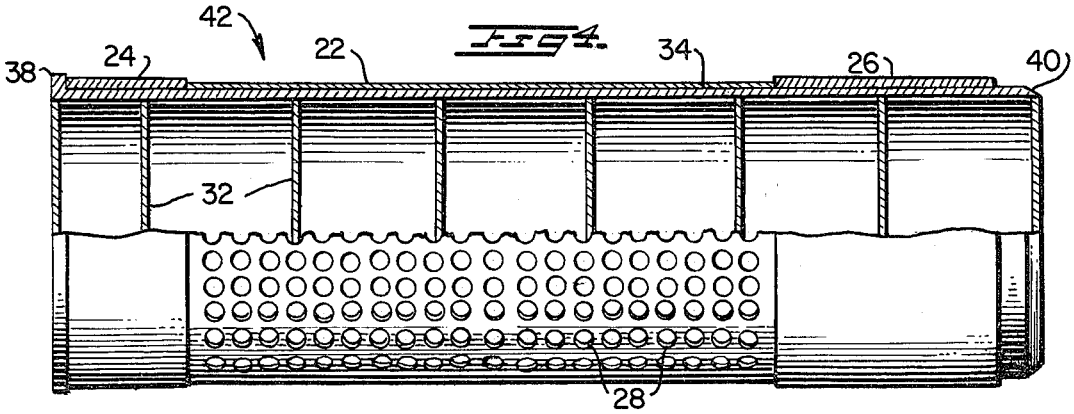
FIG. 4 is a partially sectioned side view of the workpiece assembled on the mandrel in accord with the invention.

The resulting assembly is shown in FIG. 4 and identified by reference character 42.

Assembly 42 was placed in a furnace, heated to a temperature of 1150° F., soaked at that temperature for four hours, and then air cooled, putting the 17-4 PH stainless steel from which workpiece 20 was made into the H 1150 hardened condition.

Following the air cooling step, component 20 was removed from mandrel 30 and measured. The actual internal diameter of the component was 20.053 inches. This was well within the specified 20.050+0.020−0.000 inches tolerance.

Based on the mean coefficient of thermal expansion of the respective materials, mandrel 30 would have been expected to expand 0.214 inch during the heat treating process; and workpiece 20 would have been expected to expand 0.162 inch as it was heated and to then contract 0.0008–0.0010 inch per inch in diameter as it hardened to the H 1150 condition. Consequently, from the thermal sizing point-of-view, the mandrel was 0.055 inch larger at the soaking temperature than at ambient temperature; and this was very close to the actual 0.052 inch expansion obtained in the diameter of the finished workpiece.

That this essentially perfect plastic expansion of the workpiece was obtained is surprising because, at 1150° F., 17-4 PH would be expected to respond elastically over an increase in diameter of approximately 0.04 inch. Consequently, based on published physical properties, only a negligible permanent set, or increase in size, would be predicted.

That a plastic, rather than elastic, expansion of the workpiece was obtained is important because the result is that the workpiece sets, or stabilizes, at the diameter to which it is expanded rather than restoring to a smaller diameter evidencing a perhaps negligible increase in diameter after it is cooled. The consequence is that, by expanding and sizing the workpiece in accord with my invention, it is possible to size components made of precipitation hardening stainless steels, for example, by limited expansion of those components in or near the elastic range of the workpiece material and at the temperature required to harden it.

Various applications, modifications and adaptations of my invention have been described above; and others will readily occur to those skilled in the arts to which this disclosure is directed. For example, because the temperatures at which 17-4 PH and 15-5 PH can be hardened are compatible, assemblies containing both of those materials can be concomitantly sized and hardened in accord with the principles of the present invention. The same is true of components made of PH 13-8 Mo and PH 14-8 Mo, PH 15-7 Mo, and 17-7 PH stainless steels.

Still other variations and applications of my novel process will readily occur to those to whom this disclosure is addressed. Consequently, to the extent that such variations are not expressly excluded from the appended claims, they are fully intended to be embraced therein.

The invention may also be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent of the United States is:

1. A method of fabricating a tubular component of selected dimension and physical properties which comprises the steps of: providing a workpiece which has a cylindrical configuration and is fabricated of a precipitation hardening alloy that undergoes a volume change and a change in crystalline structure during hardening and which retains a large part of its strength at the temperature required for precipitation hardening; inserting into the workpiece thus formed a mandrel fabricated of a heat resistant alloy having a higher strength and higher coefficient of expansion than the material of which the workpiece is formed; and then precisely sizing said workpiece by heating the resulting assembly at a sufficiently high temperature and for a sufficiently long time to first expand the workpiece to the wanted final dimension by expansion of the mandrel and plastic flow of the workpiece material and to then dimensionally stabilize said workpiece at said final dimension by effecting a phase change in the material of which said workpiece is fabricated that hardens said workpiece material and thereby prevents further changes in the dimensions of said material.

2. A method as defined in claim 1 which includes the step of preheating the workpiece to accommodate the assembly of it and said mandrel by eliminating the need to form said workpiece to close tolerances.

3. A method as defined in claim 1 wherein said workpiece is sized and stabilized by two heating steps, the workpiece being cooled in air after each of said heating steps.

4. A method as defined in claim 1 wherein said workpiece comprises two or more joined together components, each of said components being fabricated of a material as aforesaid.

5. A method as defined in claim 1 in which the workpiece material is a precipitation hardening stainless steel.

6. A method as defined in either of claim 1 wherein said workpiece material is selected from the group consisting of 17-4 PH, 15-5 PH, 17-7 PH, PH 13-8 Mo, PH 14-8 Mo, and PH 15-7 Mo stainless steels.

7. A method as defined in claim 1 in which the workpiece material is a heat resistant Fe-Ni-Cr-Mo alloy.

8. A method as defined in claim 1 wherein the workpiece material is a precipitation hardening 17-4 PH or 15-5 PH stainless steel and wherein said workpiece is sized and stabilized by heating it at a temperature in the range of 900°–1150° F. for one to four hours and then cooling it in air.

9. A method as defined in claim 1 wherein the workpiece material is a precipitation hardening 17-4 PH or 15-5 PH stainless steel and wherein said workpiece is sized and stabilized by, sequentially, heating it at a temperature of 1400° F. for two hours, cooling it in air, reheating it at 1150° F. for one to four hours, and cooling it in air.

10. A method as defined in claim 1 wherein the workpiece material is a PH 13-8 Mo, PH 14-8 Mo, PH 15-7 Mo, or 17-7 PH precipitation hardening steel and wherein said workpiece is sized and stabilized by heating it at a temperature in the range of 875°–1150° F. for one to four hours and then cooling it in air.

11. A method as defined in claim 1 wherein the workpiece material is a PH 13-8 Mo, PH 14-8 Mo, PH 15-7 Mo, or 17-7 PH precipitation hardening stainless steel and wherein said workpiece is sized and stabilized by, sequentially, heating it at a temperature of 1400° F. for two hours, cooling it in air, reheating it at 1150° F. for four hours, and cooling it in air.

12. A method of fabricating a tubular component of selected dimension, said method comprising the steps of: forming a material which undergoes a volume contraction upon heating into a workpiece of cylindrical configuration; inserting into the workpiece thus formed a mandrel fabricated of a heat resistant alloy having a higher strength and higher coefficient of expansion than the material of which the workpiece is formed; and then precisely sizing said workpiece by heating the resulting assembly to a temperature at which the workpiece will be expanded by expansion of said mandrel to the wanted final dimension and will undergo said volume contraction and a metallurgical phase change that will cause said workpiece to take a permanent set at said final dimension.

13. A method as defined in claim 12 wherein said workpiece is formed of a material which is precipitation hardenable.

14. A method as defined in claim 12 wherein said workpiece is formed of a material which can be hardened by aging it at an elevated temperature.

15. A method as defined in claim 1 or in claim 12 wherein the workpiece material is in an annealed condition prior to the time it is heated.

16. A method as defined in claim 1 or in claim 12 in which the mandrel is fabricated from A286 Fe-Ni-Cr-Mo alloy.

* * * * *

UNITED STATES PATENT AND TRADEMARK OFFICE

CERTIFICATE OF CORRECTION

PATENT NO. : 4,376,662

DATED : March 15, 1983

INVENTOR(S) : DANIEL J. BRIMM

It is certified that error appears in the above-identified patent and that said Letters Patent is hereby corrected as shown below:

Claim 5, line 1, insert --or in claim 12-- after "1".

Claim 6, line 1, after "of" insert --claims 1 or 12; cancel "claim 1".

Claim 7, line 1, after "1" insert --or in claim 12--.

Claim 8, line 1, after "1" insert --or in claim 12--.

Claim 9, line 1, after "1" insert --or in claim 12--.

Claim 10, line 1, after "1" insert --or in claim 12--.

Claim 11, line 1, after "1" insert --or in claim 12--.

Signed and Sealed this

*Twenty-sixth* Day of *July 1983*.

[SEAL]

*Attest:*

GERALD J. MOSSINGHOFF

*Attesting Officer*

*Commissioner of Patents and Trademarks*